US008702463B2

(12) United States Patent
Chu

(10) Patent No.: US 8,702,463 B2
(45) Date of Patent: Apr. 22, 2014

(54) METHOD AND DEVICE FOR PROVIDING FLOATING SYSTEM

(76) Inventor: Jack Shao-Chun Chu, Arcadia, CA (US)

( * ) Notice: Subject to any disclaimer, the term of this patent is extended or adjusted under 35 U.S.C. 154(b) by 286 days.

(21) Appl. No.: 12/930,562

(22) Filed: Jan. 10, 2011

(65) Prior Publication Data

US 2012/0178320 A1 Jul. 12, 2012

(51) Int. Cl.
*B63C 9/30* (2006.01)

(52) U.S. Cl.
USPC ..... 441/125

(58) Field of Classification Search
USPC ..... 441/47, 50, 125, 126, 127, 129; 114/263, 266, 267, 61.1, 264, 265; 405/219, 220
See application file for complete search history.

(56) References Cited

U.S. PATENT DOCUMENTS

| | | | | |
|---|---|---|---|---|
| 4,459,714 | A * | 7/1984 | Lin | 5/655.3 |
| 5,439,405 | A * | 8/1995 | Storey et al. | 441/127 |
| 6,783,181 | B2 * | 8/2004 | Scheurer et al. | 297/373 |
| 7,744,436 | B2 * | 6/2010 | Pole et al. | 441/82 |
| 2004/0159275 | A1 * | 8/2004 | Broderick et al. | 114/264 |
| 2006/0153643 | A1 * | 7/2006 | Basta | 405/219 |

* cited by examiner

*Primary Examiner* — S. Joseph Morano
*Assistant Examiner* — Anthony Wiest
(74) *Attorney, Agent, or Firm* — Raymond Y. Chan; David and Raymond Patent Firm

(57) ABSTRACT

A floating device of an outdoor furniture comprises a frame, at least two floaters removably disposed on the frame, at least two connecting elements respectively disposed on surfaces of the floaters for connecting with each other to bind the floaters together to form a floating system, and at least one inserter fixed on the frame, wherein at least one of the floaters is located by the inserter to block the floaters from removing from the frame.

18 Claims, 14 Drawing Sheets

METHOD AND DEVICE FOR PROVIDING FLOATING SYSTEM

BACKGROUND OF THE PRESENT INVENTION

1. Field of Invention

The present invention relates to a floating device, and more particularly to an outdoor furniture with floating device including one or more floaters and a method of binding floaters to form a floating system with predetermined pattern.

2. Description of Related Arts

On the beach, near the swimming pool or riverside, there are always chaise lounge, sofa, chair, and even bed for people to sit, to rest, to lie on enjoying the sunshine. However, these devices could only provide a simply function of resting. When the ocean wave suddenly becomes strong, or the flood comes up, or the accidents of drowning and so on happen, the life buoys and other things with floatage are always desired to save life. The beach, the swimming pool, the riverside and the like are the places with big requirements for life buoys and floating devices, if the chaise lounge, sofa, chair, or even bed used in those places could provide some floating things, like floating pads, floating cushions and the like, when an accident happens, there are a lot of usable devices to be used as life buoy, then the chance of saving life could increase. Hence, these places could become safer.

Furthermore, on the beach, people always would like to drive hydroplanes, ships and other devices, hence, some passages floating on the water are needed to provide people the approach to these places, such as the float bridge. And in the swimming pool, sometimes, people would like to play the volleyball on the water, or do other interesting game, all of which need to be processed on the water and with the floatage.

Normally these floating devices are produced with certain structures and certain functions, so they could not be used in other ways, for example, the float bridge could be used as volleyball on the water. And if there are a float bridge is not used much, it is a little waste to buy a float bridge. A better choice will be a chaise lounge, a sofa, a chair, or even a bed with floating pads, which could be composed to form a float bridge.

However, these kinds of chaise lounge, sofa, chair and bed do not exist in the market.

SUMMARY OF THE PRESENT INVENTION

It is appreciated that the present invention provides an outdoor furniture having floating device with floaters capable of being bounded together to form a floating system.

It is appreciated that the present invention provides a floating device with frame and floaters, which could be used for resting normally and could provide floaters for saving life when accident happens.

It is appreciated that the present invention provides a floating device with frame and floaters, which could be used for resting normally and could be modified or changed into a floating system for special use.

It is appreciated that the present invention provides a floating device with multiple functions that the buyer could save money.

It is appreciated that the present invention provides a floating device with multiple functions that the user could save place.

It is appreciated that the present invention provides a method for providing a floating system that the floaters could be composed to form different floating system for different use.

The present invention provides a floating device, which comprises a frame, at least two floaters removably disposed on the frame, at least two connecting elements respectively disposed on surfaces of the floaters for connecting with each other to bind the floaters together to form a floating system, and at least one inserter fixed on the frame, wherein at least one of the floaters is located by the inserter to block the floaters from removing from the frame.

It is preferred that at least one of the floater has a hollow with a shape matched with that of the inserter, which drills through the hollow to locate the floater onto the frame and to stop other floater from removing from the frame.

It is preferred that the connecting element comprises a supporter extended along edges of surface of the floater, a plurality of fixtures fixing the supporter onto the edges of the surface of the floater, and a connecter connecting the supporter of the floater with that of adjacent floater.

Furthermore, the present invention also provides a method for providing a floating system, which comprises:

providing at least one floating device comprising at least two floaters and at least two connecting elements respectively disposed on surfaces of the floaters, wherein the connecting element comprises a supporter extended along edges of surface of the floater, a plurality of fixtures fixing the supporter onto the edges of the surface of the floater, and a connecter;

arranging the floaters in a pre-determined pattern;

connecting the supporters of adjacent floaters with the connecters.

These and other objectives, features, and advantages of the present invention will become apparent from the following detailed description, the accompanying drawings, and the appended claims.

DETAILED DESCRIPTION OF THE PREFERRED EMBODIMENT

Figure 1:
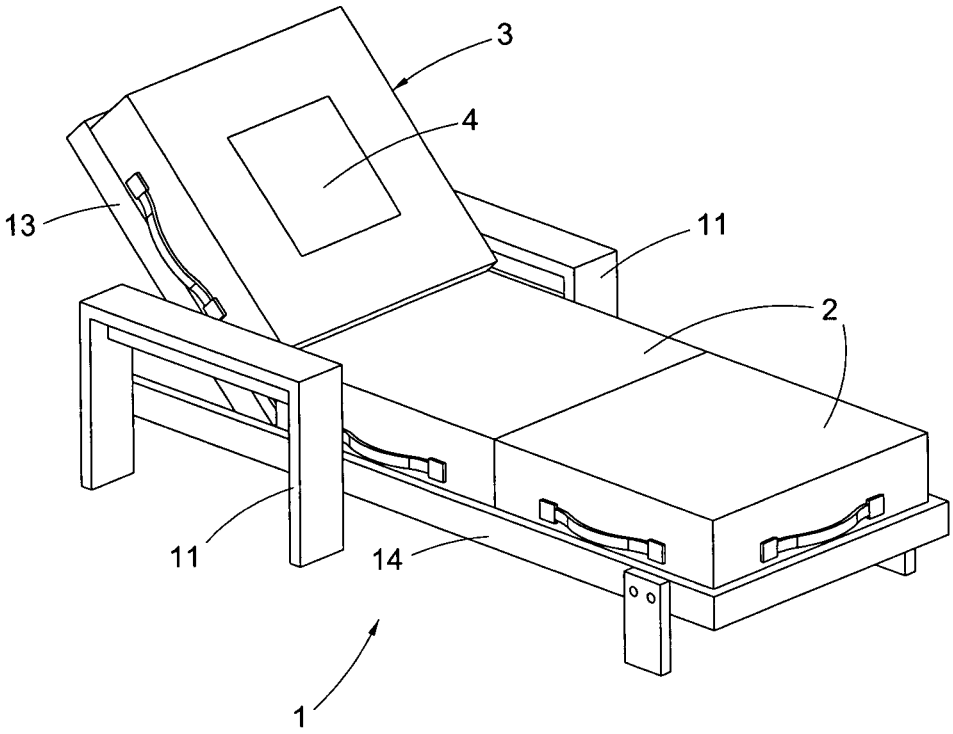
FIG. 1 is a perspective view of a floating device according to a preferred embodiment of the present invention.

Referring to FIG. 1, the present invention discloses a floating device, which comprises:

a frame 1;

at least two floaters 2 removably disposed on the frame 1;

at least two connecting elements respectively disposed on surfaces of the floaters for connecting with each other to bind the floaters together to form a floating system; and at least one inserter 4 fixed on the frame, wherein at least one of the floaters is located by the inserter to block the floaters from removing from the frame.

Preferred, at least one of the floaters 2 has a hollow with a shape matched with that of the inserter 4, which drills through the hollow to locate the floater onto the frame and to stop other floater from removing from the frame.

Figure 2A:
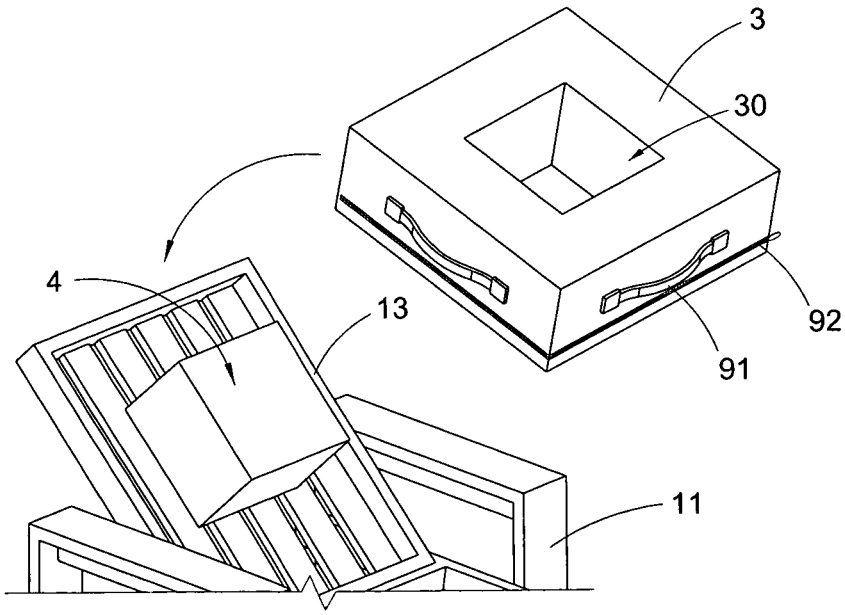
FIG. 2A is a partial explosive view of the floating device according to the above preferred embodiment of the present invention.
Figure 2B:
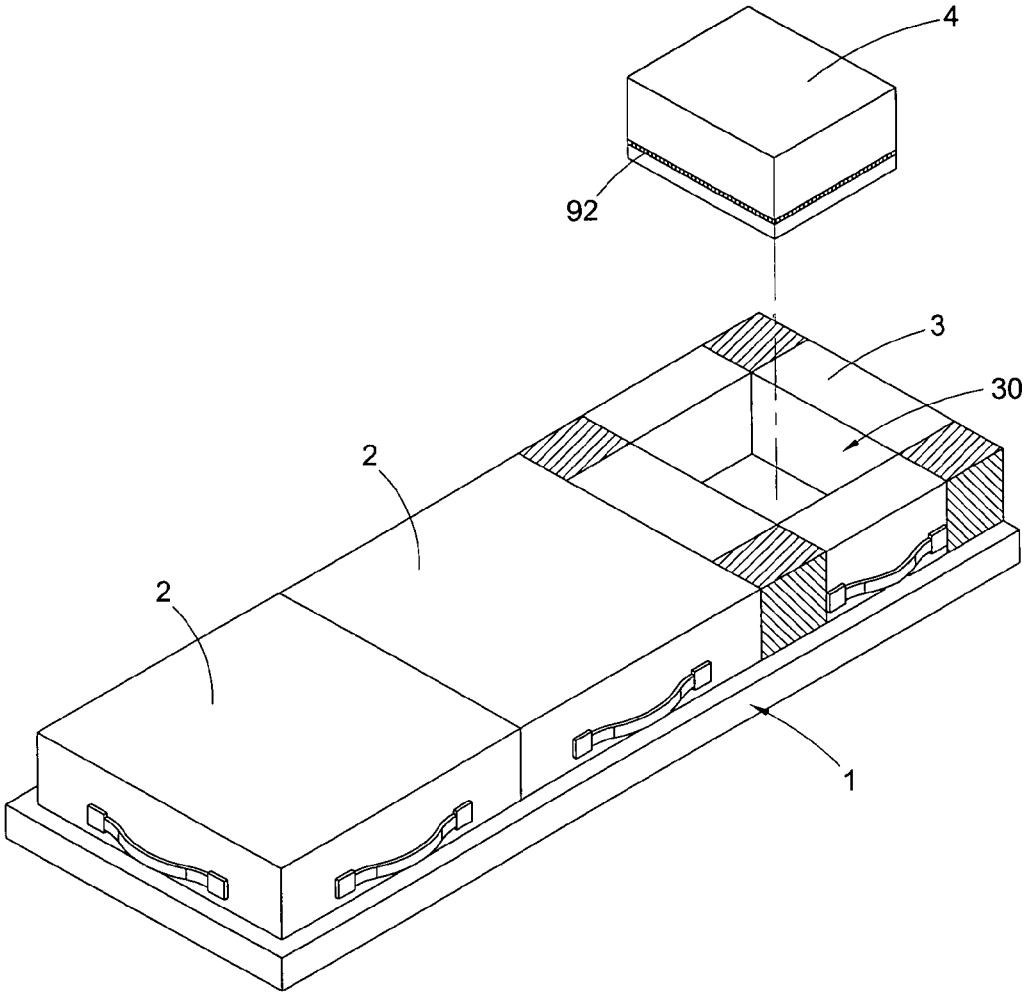
FIG. 2B is a partial explosive view of the floating device according to the above preferred embodiment of the present invention.

Referring to FIG. 2A, it is preferred that the floating device comprises at least two floaters 2 and at least one non-circular shaped boundary floater 3, embodied as square shape, with a hollow 30 disposed therein, wherein the hollow 30 has a shape matched with that of the inserter 4. Thereby when the inserter 4 is fixed on the frame 1, the square boundary floater 3 could be pushed down to the frame 1 with the hollow 30 drilled through by the inserter 4, resulting that the square boundary floater 3 will be located onto the frame 1. Referring to FIG. 2B, the square boundary floater 3 could also be put onto the frame 1 firstly, and then an inserter 4 could be pushed into the hollow 30 and fixed onto the frame to locate the square boundary floater 3 onto the frame 1.

Referring to FIGS. 1, 2A and 2B, when the floaters 2 are put onto the frame 1, the floaters 2 will be limited by the edges of the frame 1 instead of being tightly fastened thereon, hence these floaters 2 are removable disposed on the frame 1 that they are easily to be removed from the frame 1 to be further used as floating things. However, when the floating device is used as chaise lounge, sofa, chair or bed, these floaters 2 are needed to be located and fixed onto the frame 1 to be used as pads without self-moving off from the frame 1. Hence, after the floaters 2 are putted onto the frame 1 and limited by the edges thereof, a inserter 4 needs to be fixed or fastened onto the frame 1 and a non-circular shaped boundary floater 3, embodied as square shape, needs to be located by the inserter 4. Then as the square boundary floater 3 is located by the inserter 4, the square boundary floater 3 will not self-move off from the frame 1, and as the square boundary floater 3 and the floaters 2 are all limited by the frame 1, the floaters 2 will be blocked by the square boundary floater 3 and will not be easily to self-move off from the frame 1. Hence, the locating of the floaters 2 occurs.

At this time, the floaters 2 are tightly limited by the frame 1, so it is a little hard for people to take them out of the frame 1. Hence, the floater 2 further has at least one handle 91 disposed on the lateral surface to make the floater 2 could be easily pulled out from the frame 1. Meanwhile, the square boundary floater 3 could also has the handle 91 disposed on the lateral surface for the same use. More preferred, as the square boundary floater 3 has a hollow 30 provided therein, it could be used as a lifebelt, and meanwhile as the square boundary floater 3 has a square shape and a connecting element, it is capable of being tightly assembled with other square floaters 3 by the connecting elements to form a big floating deck, such as a floating bridge.

Figure 3:
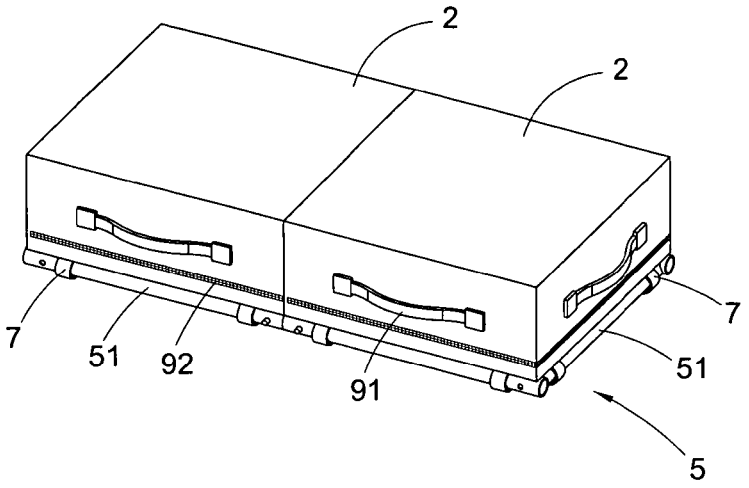
FIG. 3 is a perspective view of the floater according to a first preferred embodiment of the present invention.
Figure 6:
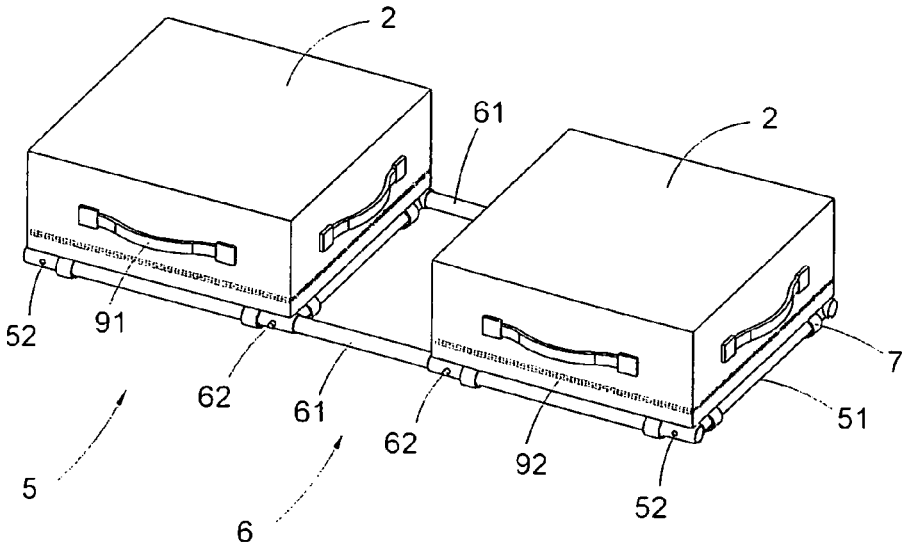
FIG. 6 is a perspective view of the connected floaters according to the above preferred embodiment of the present invention.

Referring to FIG. 3 and FIG. 6, the connecting element comprises a supporter 5 extended along edges of surface of the floater 2, a plurality of fixtures 7 fixing the supporter 5 onto the edges of the surface of the floater 2, and a connecter 6 connecting the supporter 5 of the floater 2 with that of adjacent floater 2.

Referring to FIGS. 4A~4B and 5A~5C, it is preferred that the supporters 5 are disposed on the bottom surface of the floater 2. The supporter 5 comprises four supporting bars 51 respectively extending along and being fixed by the plurality of fixtures 7 onto four edges of the surface of the floater 2, and the four supporting bars connect with each other sequentially to form a square supporting frame fixed onto the surface of the floater 2.

Figure 4A:
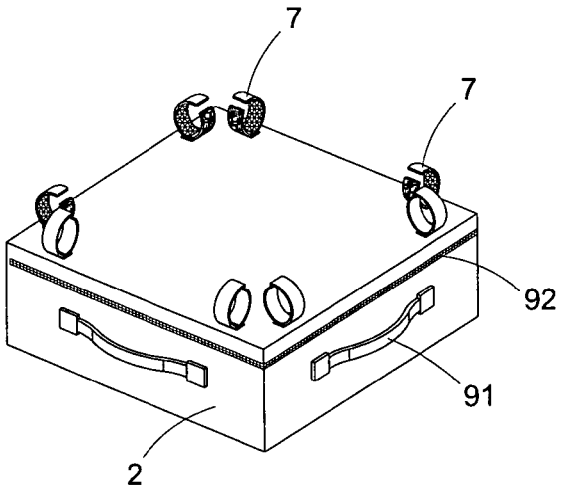
FIG. 4A is a perspective view of the floater according to the above preferred embodiment of the present invention, illustrating the process of fixing a supporter with a fixture.
Figure 4B:
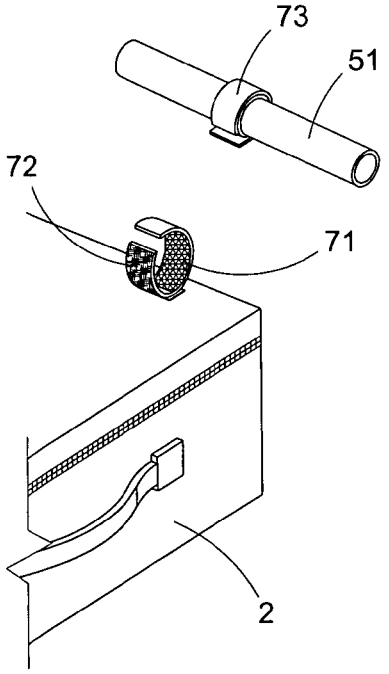
FIG. 4B is a partial explosive view of the floater according to the above preferred embodiment of the present invention, illustrating the process of fixing a supporter with a fixture.

Referring to FIGS. 4A~4B, the fixture 7 comprises a first adhesion surface 71, a second adhesion surface 72 and an adhesion belt 73. The second adhesion surface 72 is fixed onto the surface of the floater 2. The adhesion belt 73 surrounds the supporting bar 51 of the supporter 5 and could be adhered to the first adhesion surface 71 to fasten the supporting bar 51 of the supporter 5 with the fixture 7. Furthermore, the first adhesion to surface of one end of the fixture 7 is adhered to the second adhesion surface of the other end of the fixture 7 to form a ring with the first adhesion surface as inner surface, which is adhered to the adhesion belt to fix the supporting bar 51 with the fixture, thereby the supporter is fixed onto the floater by the fixtures.

When using, firstly surrounds the supporting bar 51 of the supporter 5 with the second adhesion surface 72 to make the adhesion belt 73 adhered to the second adhesion surface 72, and then adhere the first adhesion surface 71 of one end of the fixture 7 to the second adhesion surface 72 of the other end of the fixture 7 to form a ring which further limits and locates the supporting bar 51 of the supporter 5. Thereby, the supporting bar 51 of the supporter 5 is fixed onto the floater 2 by the fixtures 7.

It is preferred that the supporting bar 51 is fixed onto the floater by at least two fixtures.

Figure 5A:
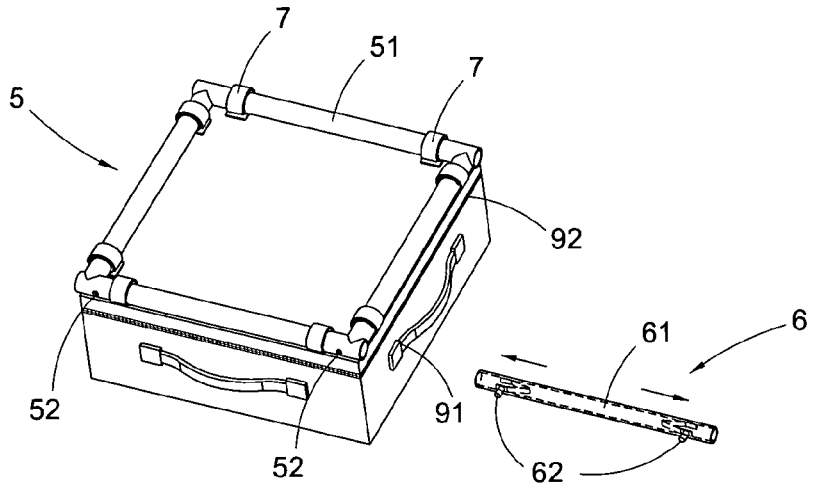
FIG. 5A is an explosive view of the floater according to the above preferred embodiment of the present invention, illustrating the process of connecting a connecter with a supporter.

Here, a floater 2 with the supporter 5 fixed thereon by the fixtures 7 is obtained as shown in FIG. 5A. It is preferred that the supporting bar 51 of the supporter 5 has two connecting holes 52 disposed on two ends thereof and the connecter 6 comprises a connecting bar 61 and two connecting plugs 62 disposed on two ends thereof. Referring to FIG. 5C, the connecting bar 61 has a smaller diameter than that of the supporting bar 51, and one end of the connecting bar 61 could be pushed into cavity of one end of the supporting bar 51, and then the plug 62 disposed on the end of the connecting bar 61 will plug into the connecting hole 52 disposed on the end of the supporting bar 51, thereby the connecter 6 is connected to the supporter 5.

Referring to FIG. 5C, it is preferred that the connecting bar 61 further has two holes 63 disposed on the two ends and the connecting plug 62 has a plug 621 drilled through the hole 63 and an elastic element 622 connected with the plug 621 and disposed inside of the connecting bar 61. When the connecting plug 62 is being pressed, the plug 621 will further press the elastic element 622, which subsequently contracts to permit the plug 621 to be pushed into the cavity of the connecting bar 61. When the connecting plug 62 is released from the pressure, the elastic element 622 stretches to force the plug 621 drill out off the hole 63 to provide a plugging function.

Referring to FIG. 5C, when the connecting bar 61 is pushed into the supporting bar 51, the connecting plug is forced by the sidewall of the supporting bar 51 to move into the cavity of the connecting bar 61, thereby the connecting bar 61 could be smoothly inserted into the cavity of the supporting bar 51 to reach a position that the connecting plug 62 and the connecting hole 52 are overlapped, then the connecting plug 62 is released from being pressed by the sidewall of the connecting bar 51 and will stretch to plug into the connecting hole 52, resulting that the connecting bar 61 and the supporting bar 51 are connected together.

Figure 5B:
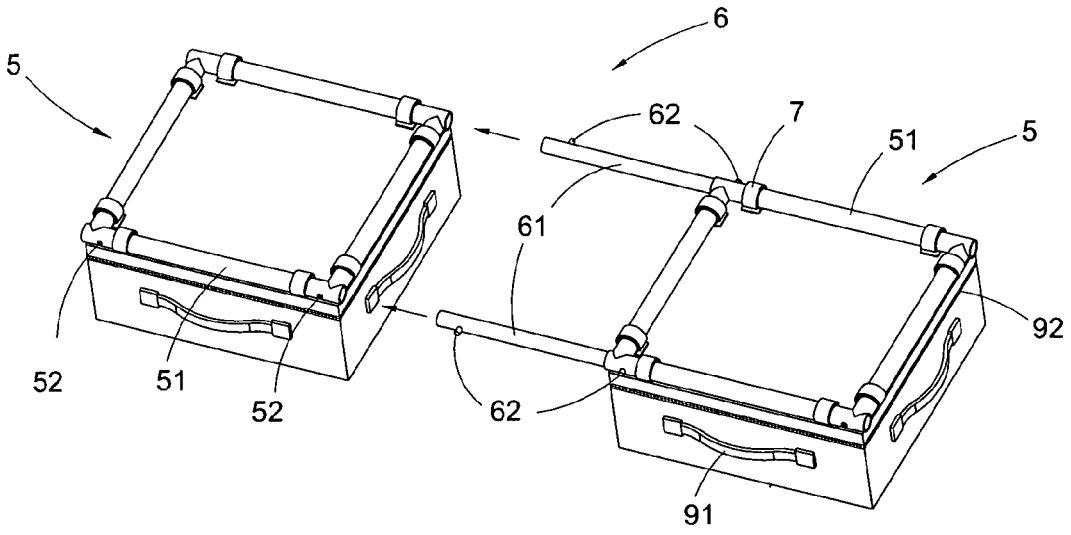
FIG. 5B is an explosive view of the floater according to the above preferred embodiment of the present invention, illustrating the process of connecting a connecter with another supporter.
Figure 5C:
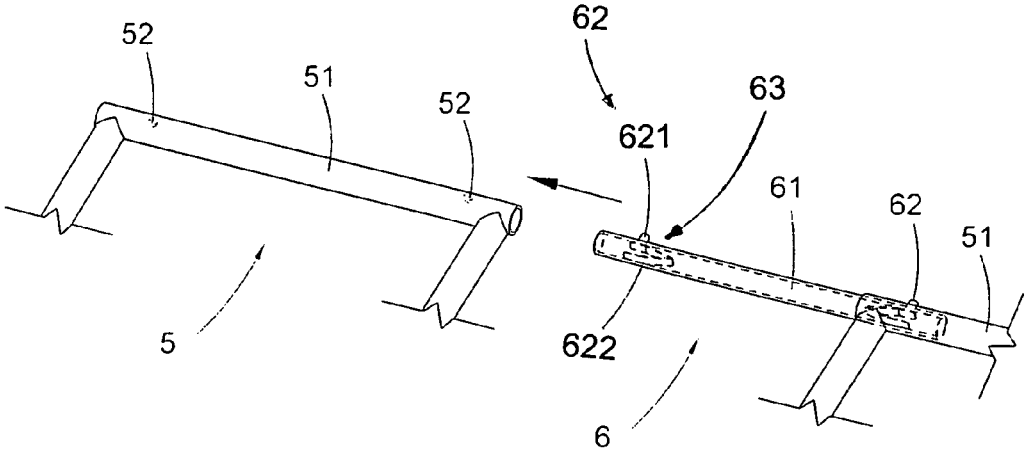
FIG. 5C is a partial enlarged view of the floater according to the above preferred embodiment of the present invention, illustrating the connecting structure of the connecter and the supporter.

Referring to FIGS. 5A and 5B, firstly insert one end of a connecter 6 into one end of a supporting bar 51 of a supporter 5 of a floater 2 to connect the supporter 5 to the connecter 6, then insert another end the connecter 6 into one end of a supporting bar 51 of a supporter 5 of another floater 2 to connect this supporter 5 to the connecter 6, thereby the first floater 2 is connected with the second floater 2 by the connecter 6.

Referring to FIG. 6, the supporter 5 of the floater 2 is connected with that of other floaters 5 by the connecter 6 to bind at least two floaters 2 together to form a floating system. In this floating system, the floaters 2 could be connected one by one to extend along the water and form a desired pattern, such as a road on the water, a bridge on the water, or even a ground on the water.

Figure 7:
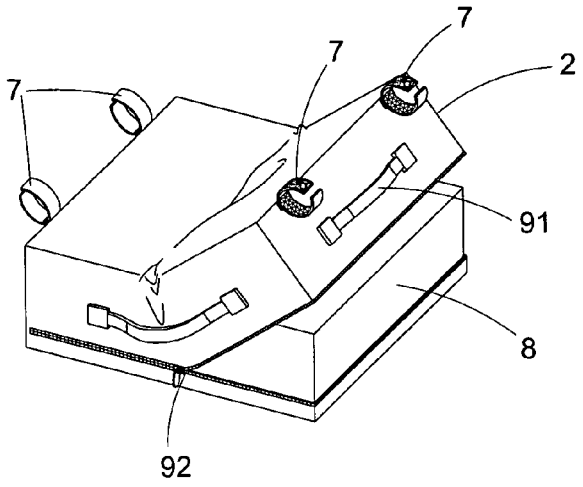
FIG. 7 is a perspective view of the floater according to the above preferred embodiment of the present invention.

It is preferred that the floater 2 has a case, preferred waterproof case, which could be opened by a slide fastener 92 disposed thereon, then a floatable body 8 could be filled into the cavity of the case to provide the required floatage, as illustrated in FIG. 7, thereby the floaters 2 could be assembled together with or without a frame to provide enough floatage to permit the users to sit, to lay or to stand thereon.

Figure 8:
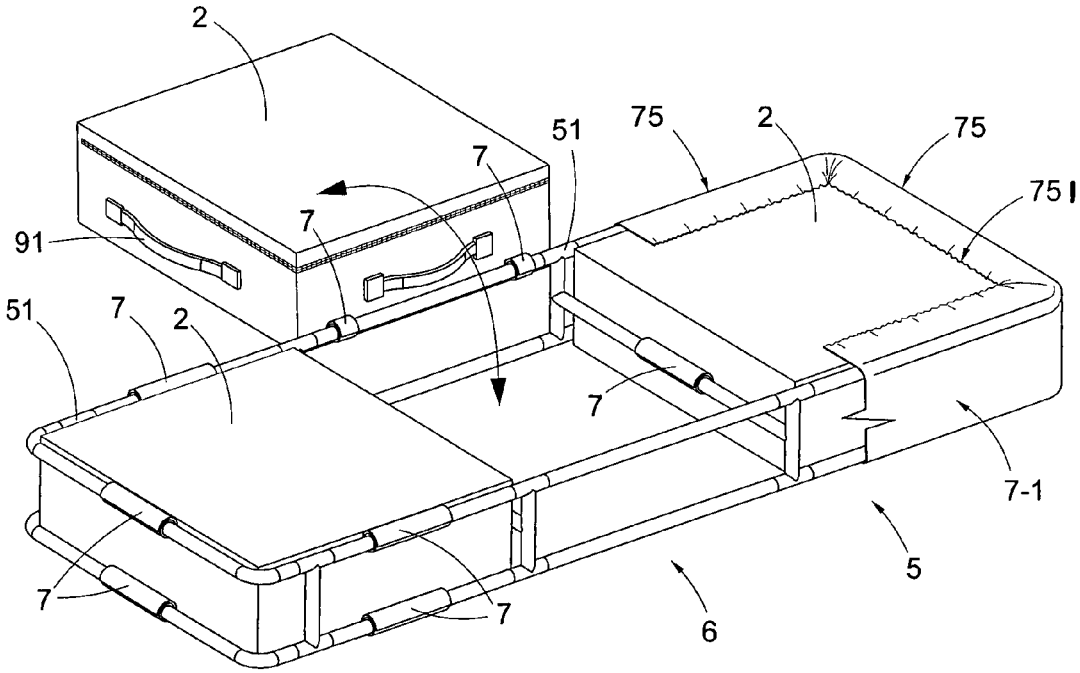
FIG. 8 is a perspective view of the connected floaters according to a second preferred embodiment of the present invention.

FIG. 8 illustrates another preferred embodiment of the floater 2. In order to fasten two or more floaters 2 together, the floater 2 could has two supporters 5 affixed on the top surface and on the bottom surface, wherein the two supporters 5 are respectively connected with two supporters 5 of another floater 2 by at the connecters 6 to bind the floaters 2 together. Furthermore, the fixture 7 further comprises a waterproof fabric made cover 7-1 covering the floaters 2 and the supporters 5, wherein the cover 7-1 having a surrounding edge portion 75 surrounding the supporters 5 on the top surface and the supporter 5 on the bottom surface to enclose or limit respective floater 2 therein and an elastic element 751 provided around the surrounding edge portion 75 for mounting and holding the cover 7-1 in position. As a result, the floaters 2 could be better connected to the supporters 5 to provide an assemble of floaters 2 strong enough to be used as a bed cushion.

Figure 9A:
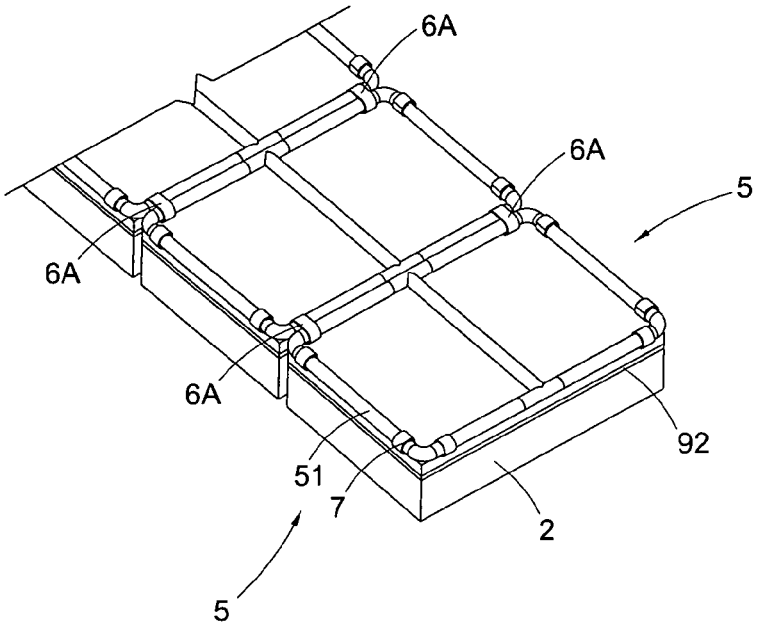
FIG. 9A is a perspective view of the connected floaters according to a third preferred embodiment of the present invention.

FIG. 9A illustrates another preferred embodiment of the floater 2. The supporter 5 is a bar ring extended along edges of surface of the floater 2, the connecter 6 is a connecting ring surrounding the supporting bars 51 of the supporters 5 of adjacent two floaters 2 to connect the supporters 5 with each other, thereby the two floaters 2 are bound together.

Referring to FIG. 9A, the floaters 2 are square and are arranged in such a manner that adjacent floaters 2 are contacted with each other that the adjacent edges are parallel and contacted. Then the supporter 5 is square, as the supporter 5 extends along the edges of the floater 2, the supporters 5 of adjacent two floaters 2 are arranged with adjacent edges parallel and connected. Then at least two connecters 6 will be used to surround the adjacent supporting bars 51 of the adjacent two supporters 5, thereby the adjacent two floaters are bounded together with edges parallelly connected with each other.

Figure 9B:
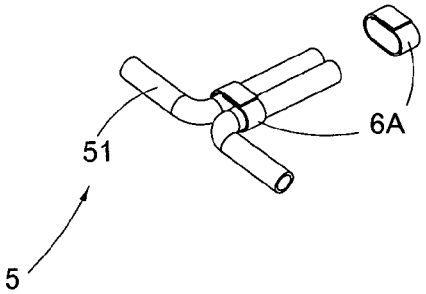
FIG. 9B is a perspective view of the connecter according to the above preferred embodiment of the present invention.

Referring to FIG. 9B, the connecter 6 is a connecting ring with one end removable adhered to the other end, such as a belt 6A, wherein the ring 6A could surround the two adjacent supporters 5 and then self-adhere one end with the other end to form a circle tightly surrounding the supporters 5, thereby that the supporters 5 are bounded.

Figure 9C:
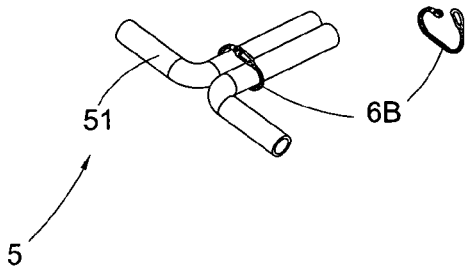
FIG. 9C is a perspective view of the connecter according to the above preferred embodiment of the present invention.

Referring to FIG. 9C, the connecter 6 is a connecting ring with one end removable locked with the other end, such as a ring 6B with a loop on one end and a hook on the other end, wherein the ring 6B could surround the two adjacent supporters 5 and then self-lock the loop with the hook to form a circle tightly surrounding the supporters 5, thereby the supporters 5 are bounded.

Figure 10:
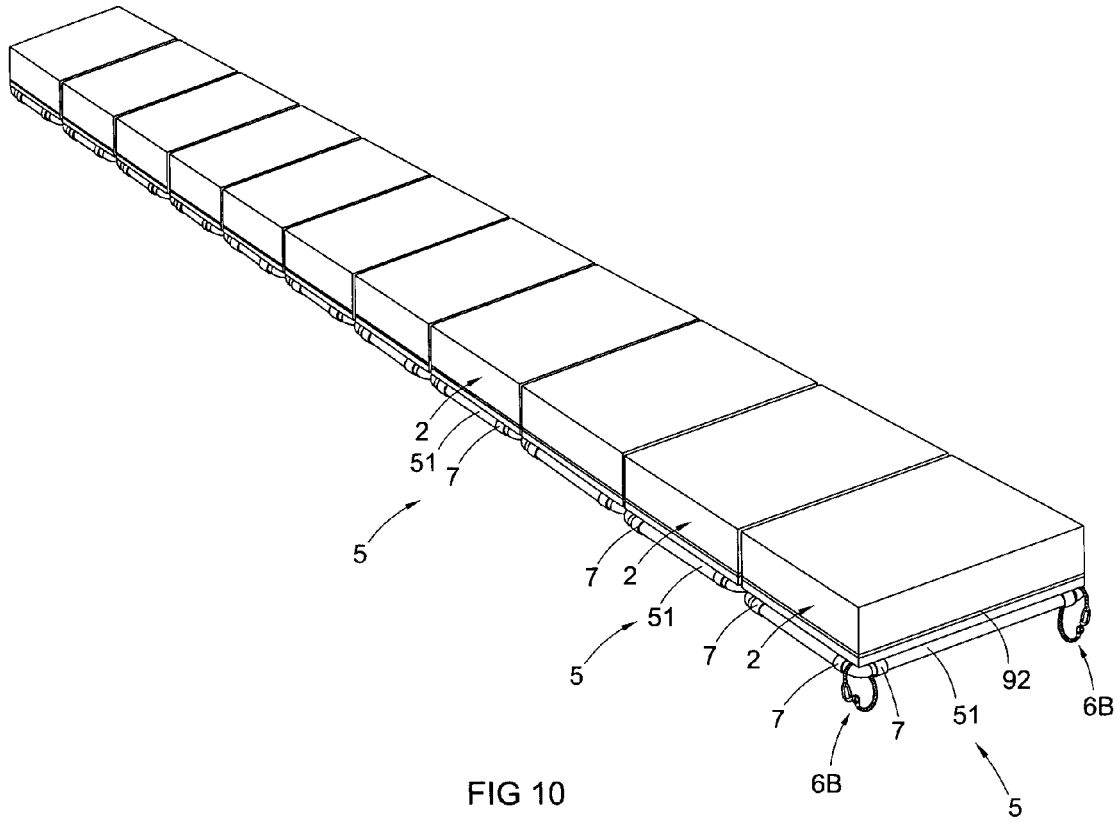
FIG. 10 is a perspective view of the floating system formed by the connected floaters according to the above preferred embodiment of the present invention.

When the floaters 2 are arranged contacted with each other and are bounded with the connecter 6, a floating system as illustrated in FIG. 10 will be obtained, which could be used as a passage on water, such as a floating bridge, or be used as a float board or a floating bed on the water, and even be used in the swimming pool as a block, which could be jumped over to provide a new game of jump style swimming like dolphin.

It is preferred that the supporter 5 is fixed onto the floater 2 by at least four fixtures 7.

Figure 11A:
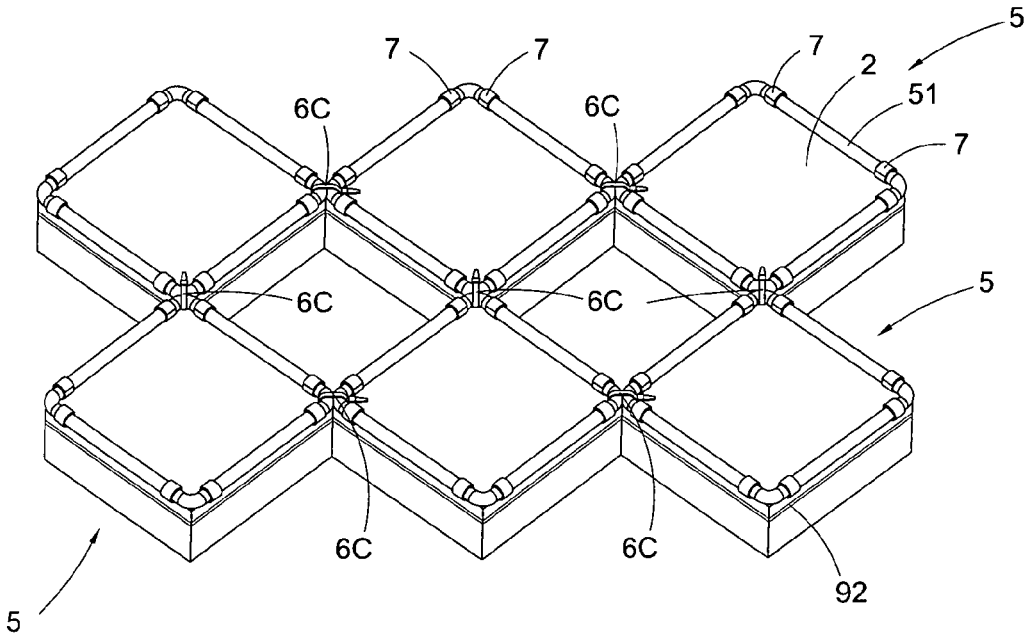
FIG. 11A is a perspective view of the connected floaters according to a fourth preferred embodiment of the present invention.
Figure 11B:
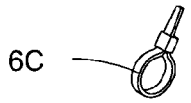
FIG. 11B is a perspective view of the connecter according to the above preferred embodiment of the present invention.
Figure 11C:
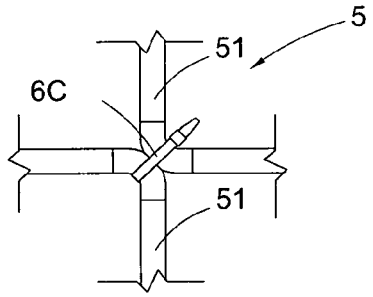
FIG. 11C is a partial enlarged view of the connecter according to the above preferred embodiment of the present invention, illustrating the connecting structure of the connecter and the supporters.

Referring to FIGS. 11A to 11C, the floaters 2 are in non-circular shape, embodied as a square shape, and are arranged with apex angles oppositely contacted with each other. Then the supporter 5 is in non-circular shape, embodied as a square shape, as the supporter 5 extends along the edges of the floater 2, the supporters 5 of adjacent two floaters 2 are arranged with adjacent apex angles opposite and connected. Hence, the connecters 6 could be used on the apex angle portion to bind the adjacent supporters 5 together.

In order to bind the floaters 2 together in the apex angle portion, it is preferred that the connecter 6 is a connecting ring with one end removable fixed with the other end, such as the fixing ring 6C as illustrated in FIG. 11B. The fixing ring 6C has a ring and a clip disposed thereon, wherein the ring could surround the two adjacent supporters 5 and then the two ends of the ring is self-fixed together by the clip to form a circle tightly surrounding the supporters 5, thereby the supporters 5 are bounded.

Figure 12:
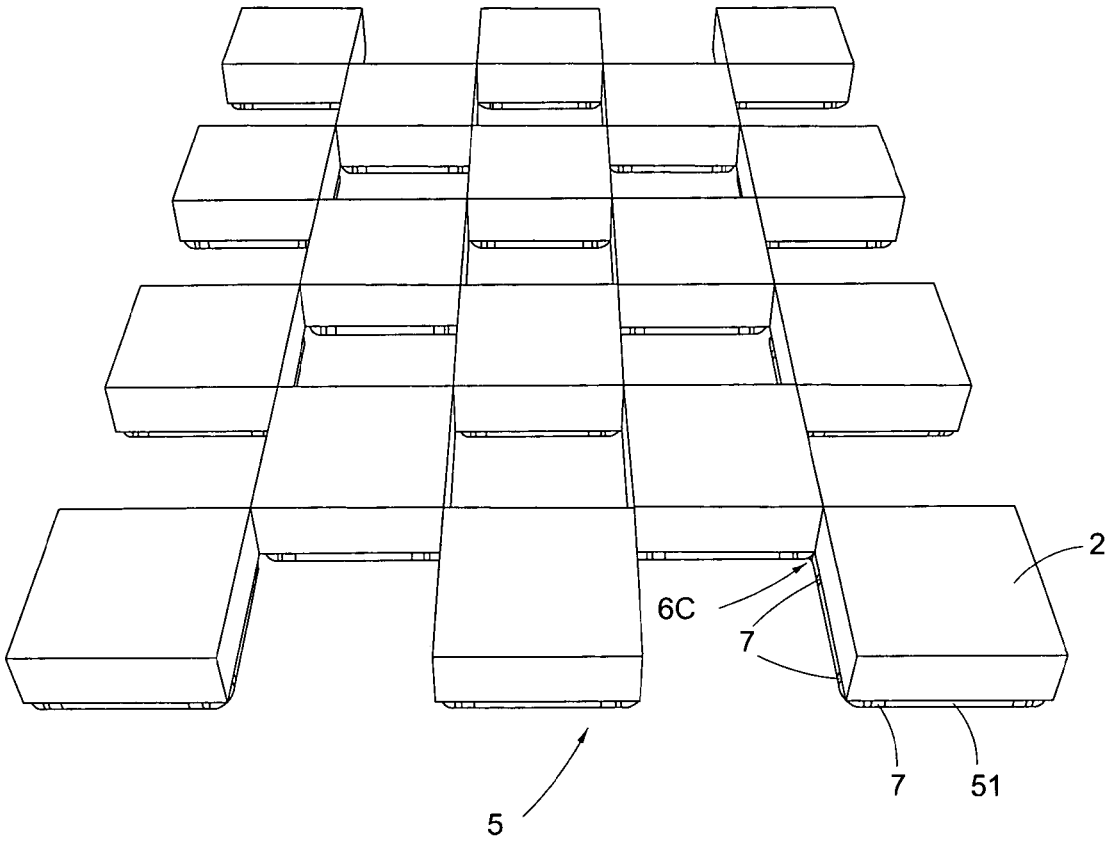
FIG. 12 is a perspective view of the floating system formed by the connected floaters according to the above preferred embodiment of the present invention.

When the floaters 2 are arranged with apex angles contacted with each other and are bounded with the connecters 6, a floating system as illustrated in FIG. 12 will be obtained, which could be used as a ground on the water for playing games thereon, or be used as a stage for playing the ballet or other performances.

Figure 13A:
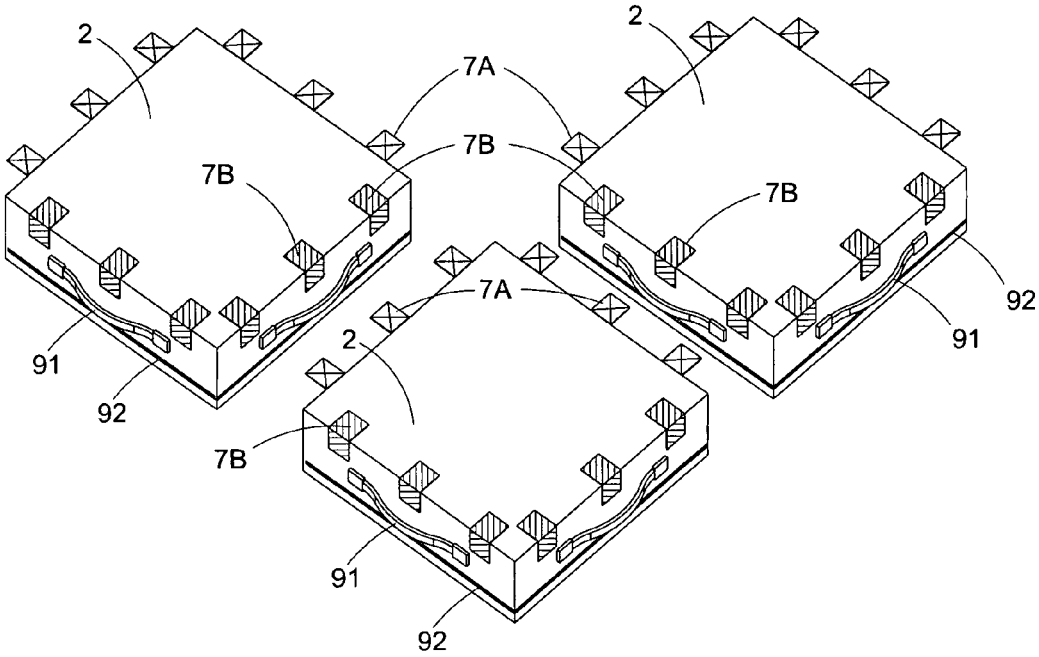
FIG. 13A is a perspective view of the connected floaters according to a fifth preferred embodiment of the present invention.
Figure 13B:
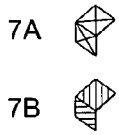
FIG. 13B is a perspective view of the connecting elements according to the above preferred embodiment of the present invention.
Figure 13C:
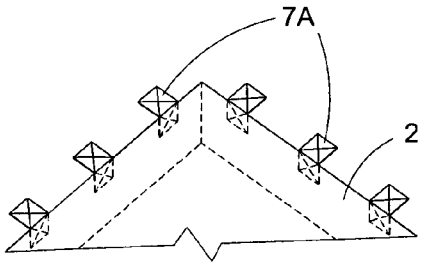
FIG. 13C is a partial enlarged view of the floater according to the above preferred embodiment of the present invention, illustrating the connecting structure of the connecting elements and the floater.

Referring to FIGS. 13A to 13C, the connecting element further comprises a plurality of first connecting elements 7A and a plurality of second connecting elements 7B disposed on the surface of the floater 2, wherein the plurality of first connecting elements 7A of one floater 2 are respectively connected with the plurality of second connecting elements 7B of adjacent floater 2 to bind the two floaters 2 together.

It is preferred that the floater 2 is in non-circular shape, embodied as a square shape, with two adjacent edges disposed with the first connecting elements 7A and another two adjacent edges disposed with the second connecting elements 7B. The plurality of first connecting elements 7A of one floater 2 is respectively connected with the plurality of second connecting elements 7B of adjacent floater 2 to bind the two floaters 2 together.

It is preferred that the floaters 2 are arranged in such a manner that adjacent edges of the adjacent floaters respectively have the first connecting elements 7A and the second connecting elements 7B disposed thereon that the adjacent edges could be connected with each other to bind the floaters 2 together.

Figure 14:
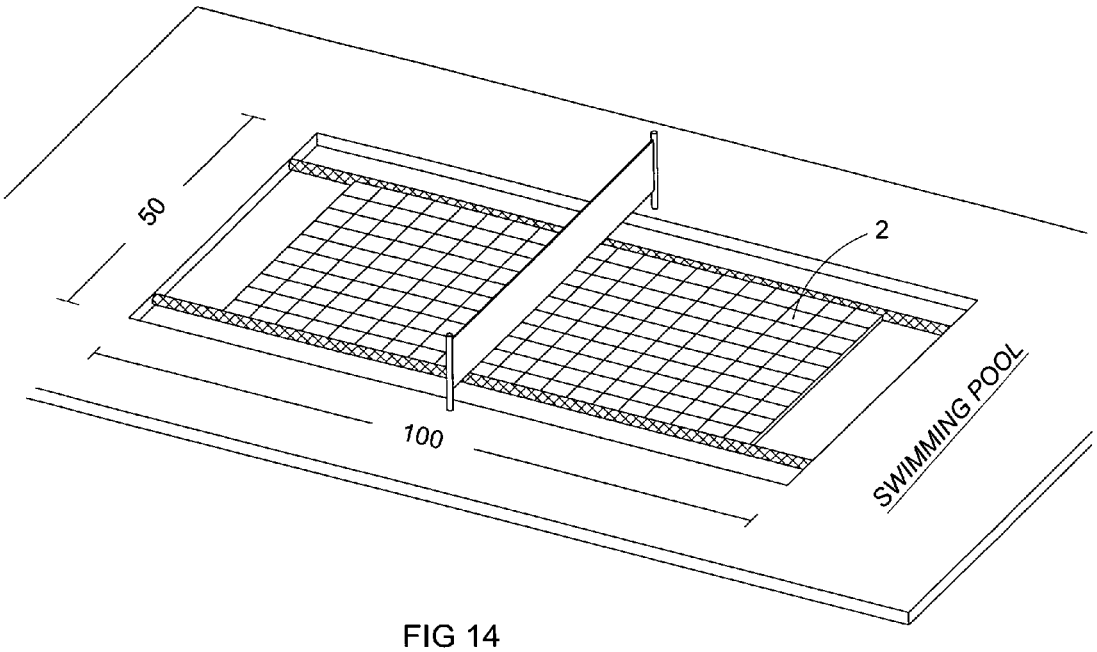
FIG. 14 is a perspective view of the floating system formed by the connected floaters according to the above preferred embodiment of the present invention.

The first connecting elements 7A and the second connecting elements 7B could be used alone to bind the floaters together. Alternatively, The first connecting elements 7A and the second connecting elements 7B could be used together with the connecting elements and connecting means mentioned above to further bind the floaters 2 more tightly. This is very important when the floating system formed by the floaters 2 is used as a volleyball court or a badminton court on the water or in the swimming pool, as illustrated in FIG. 14.

It is preferred that the floating device could be used as chaise lounge, sofa, chair or bed, especially used on the beach or near the swimming pool. Hence, the frame 1 comprises at least one main body frame with the floaters 2 disposed thereon and at least two support legs 11 supporting the main body frame.

Figure 15A:
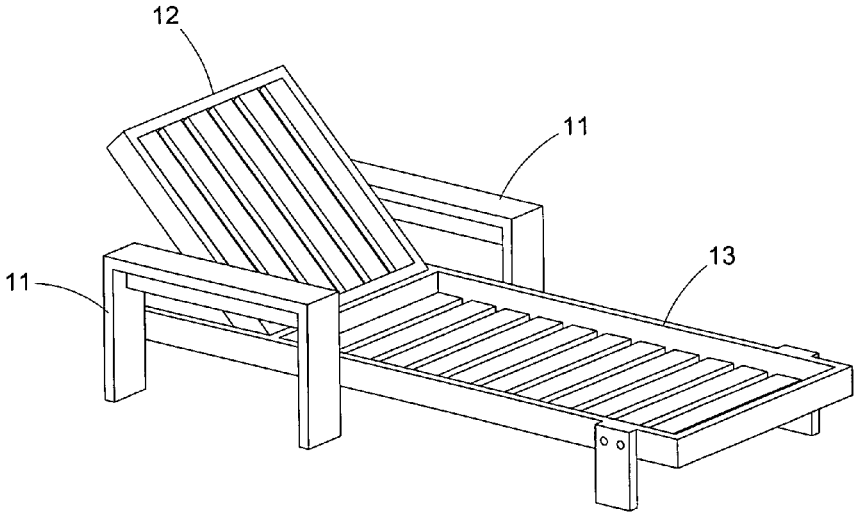
FIG. 15A is perspective view of the frame according to another preferred embodiment of the present invention.

Referring to FIG. 15A, when the floating device is designed as a chaise lounge, the frame 1 comprises two support legs 11, a short main body frame 12 and a long main body frame 13, wherein the short main body frame 12 and the long main body frame 13 are connected with each other and are supported by the support legs 11. Two or more floaters 2 could be disposed on the long main body frame 13 and be used as pads, and a non-circular boundary floater 3 and an inserter 4 could be affixed on the short main body frame 13 to block the floaters 2 from removing from the frame.

Figure 15B:
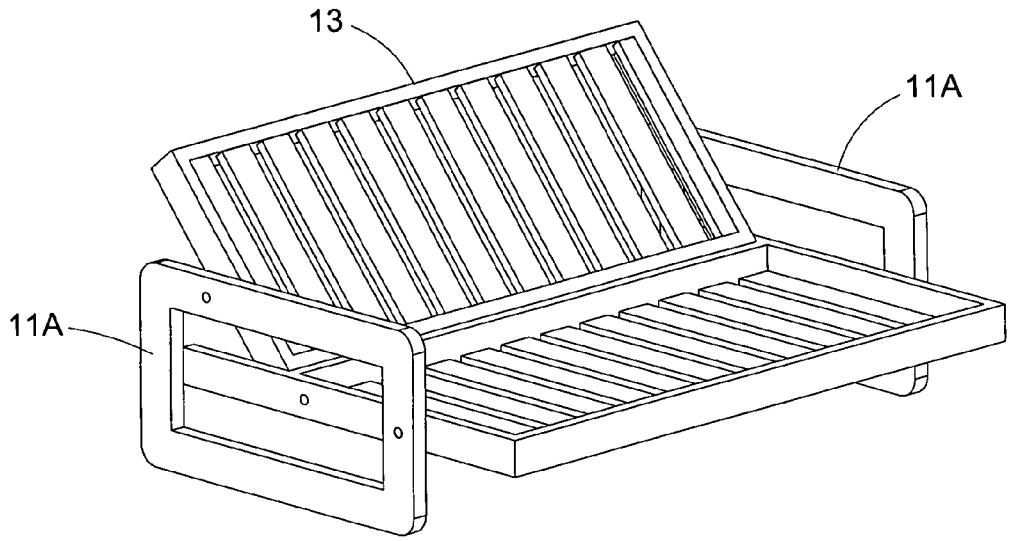
FIG. 15B is perspective view of the frame according to another preferred embodiment of the present invention.

Referring to FIG. 15B, when the floating device is designed as a sofa, the frame 1 comprises two support legs 11 and two long main body frames 13 connected with each other and supported by the support legs 11. Two or more floaters 2 could be disposed on the long main body frame 13 and be used as pads.

Figure 15C:
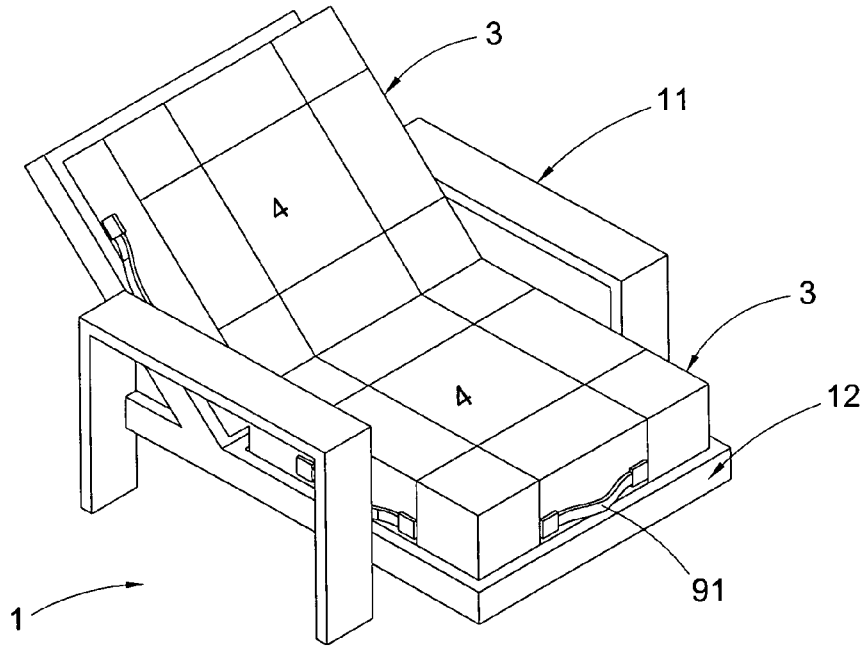
FIG. 15C is perspective view of the frame according to another preferred embodiment of the present invention.

Referring to FIG. 15C, when the floating device is designed as a chair, the frame 1 comprises two support legs 11 and two short main body frames 12 connected with each other and supported by the support legs 11. A non-circular boundary floater 3 and an inserter 4 could be fixed on the short main body frame 13 and be used as pads.

Figure 15D:
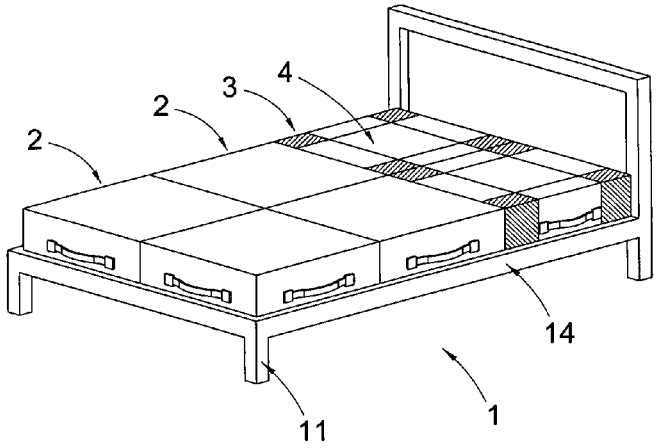
FIG. 15D is perspective view of the frame according to another preferred embodiment of the present invention.
Figure 15E:
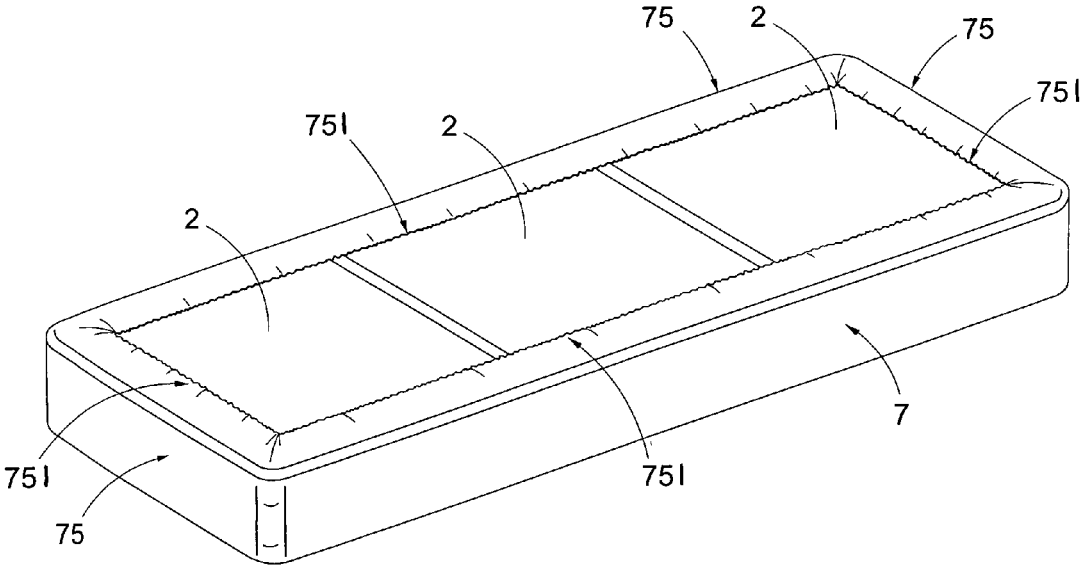
FIG. 15E is perspective view of the frame according to another preferred embodiment of the present invention.

Referring to FIG. 15D, when the floating device is designed as a bed, the frame 1 comprises four support legs 11 and one wide main body frames 14 supported by the support legs 11. At least two floaters 2, at least one non-circular shaped boundary floater 3, embodied as a square shape, and at least one inserter 4 could be disposed on the wide main body frames 14 and be used as mattress.

In order to provide a strong enough bed as illustrated in FIG. 15D, the floaters 2, as well as the non-circular boundary floater 3 and the inserter 4, could be connected with each other by the supporters as illustrated in FIG. 8, resulting that the floaters 2, the non-circular boundary floater 3 and the inserter 4 have been affixed both on the top surfaces and on the bottom surfaces and then have been limited by the elastic elements 751. Hence, the floaters 2, the boundary floater 3 and the inserter 4 could be tightly connected with each other to form a bed cushion, which is used on the frame 1 as illustrated in FIG. 15D.

As mentioned above, the floating devices as illustrated in FIGS. 15A-15E could be used as normal fitments in the house, near the swimming pool, on the beach or in the other suitable places. However, the floaters 2 of these floating devices could be removed off to be further connected together as mentioned above to form a floating system according to the requirements. And the square floaters 3 of these floating devices could also be removed off to be used as lifebelts for saving people.

It is preferred that the locator 4 is a floater having the same structures of the floater 2, but with a smaller size. Thereby the inserter 4 could also be used to provide floatage and be used as pad.

The present invention also discloses a method for providing a floating system, which comprises the steps of:

providing at least one floating device comprising at least two floaters 2 and at least two connecting elements respectively disposed on surfaces of the floaters 2, wherein the connecting element comprises a supporter 5 extended along edges of surface of the floater 2, a plurality of fixtures 7 fixing the supporter 5 onto the edges of the surface of the floater 2, and a connecter 6;

It is preferred that the floaters 2 are arranged parallel with each other and with a certain distance between each other, as illustrated in FIGS. 6 and 8.

It is preferred that the supporter 5 comprises four supporting bars respectively extending along and being fixed by the plurality of fixtures 7 onto four edges of the surface of the floater 2.

It is preferred that the supporting bar 51 has two connecting holes 52 disposed on two ends thereof and the connecter 6 comprises a connecting bar 61 and two connecting plugs 62 disposed on two ends thereof, wherein the connecting bar 61 has a smaller diameter than that of the supporting bar 51.

It is preferred that the step of connecting the supporters 5 of adjacent floaters 2 with the connecters 6 further comprises the steps of:

pushing one end of the connecting bar 61 into cavity of one end of a supporting bar 51 of a floater 2 to let the connecting plug 62 disposed on the end of the connecting bar 61 plug into the connecting hole 52 disposed on the end of the supporting bar 51;

pushing another end of the connecting bar 61 into cavity of one end of another supporting bar 51 of adjacent floater 2 to let the plug 62 disposed on the end of the connecting bar 61 plug into the connecting hole 52 disposed on the end of the supporting bar 51; and repeating connecting step to bind adjacent floaters 2 with each other.

Referring to FIGS. 9A to 9C, in another preferred embodiment, the floaters 2 are arranged parallel with each other and contacted with each other. The supporter 5 is a bar ring extended along edges of surface of the floater 2, the connecter 6 is a connecting ring 61 surrounding bars of the supporters 5 of adjacent two floaters 2 to connect the supporters 5 with each other, and thereby the two floaters 2 are bound together, wherein the supporter 5 is in non-circular shape, embodied as a square shape.

It is preferred that the step of connecting the supporters 5 of adjacent floaters 2 with the connecters 6 further comprises the steps of:

arranging the supporters 5 of adjacent two floaters 2 with adjacent edges parallel and contacted;

surrounding the supporters 5 with at least two connecters 6 on parallel portion; and repeating connecting step to bind adjacent floaters 2 with each other.

The connecter 6 is a connecting ring with one end removable adhered to the other end, or a connecting ring with one end removable locked with the other end, or a connecting ring with one end removable fixed with the other end.

Referring to FIGS. 11A to 11C, in another preferred embodiment, the floaters 2 are arranged with adjacent apex angles opposite and contacted with each other. The supporter 5 is a bar ring extended along edges of surface of the floater 2, the connecter 6 is a connecting ring surrounding bars of the supporters 5 of adjacent two floaters 2 to connect the supporters 5 with each other, and thereby the two floaters 2 are bound together, wherein the supporter 5 is in non-circular shape, embodied as a square shape.

It is preferred that the step of connecting the supporters 5 of adjacent floaters 2 with the connecters 6 further comprises the steps of:

arranging the supporters 5 of adjacent two floaters 2 with adjacent apex angles opposite and contacted;

surrounding the supporters 5 with at least two connecters 6 on the contacted apex angles portion; and repeating connecting step to bind adjacent floaters 2 with each other.

surrounding the supporters 5 with at least two connecters 6 on the contacted apex angles portion; and repeating connecting step to bind adjacent floaters 2 with each other.

The connecter 6 is a connecting ring with one end removable adhered to the other end, or a connecting ring with one end removable locked with the other end, or a connecting ring with one end removable fixed with the other end.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor furniture, comprising:

a frame;

at least two floaters removably disposed on said frame;

at least two connecting elements respectively disposed on surfaces of said floaters to connect said floaters together to form a floating system, wherein at least one of said connecting elements is provided at each of said floaters, wherein said connecting element comprises a supporter extended along edges of surface of said floater, a plurality of fixtures fixing said supporter onto said edges of said surface of said floater, and a connector, wherein said supporter comprises one or more supporting bars respectively extending along and being fixed by said plurality of fixtures onto edges of said surface of said floater, wherein said one or more supporting bars connect with each other sequentially to form a non-circular shaped supporting frame fixed on said surface of said floater; and at least one inserter, wherein at least one of said floater has a hollow, wherein said inserter is fixed on said frame and pushed into said hollow in such a manner that said floaters are prevented from self-moving from said frame and said floaters are also capable of being pulled away from said frame for life saving purpose during an emergency.

2. The outdoor furniture, as recited in claim 1, further comprising at least one handle provided on said floaters for facilitating said floaters to be pulled away from said frame.

3. The outdoor furniture, as recited in claim 2, wherein said supporting bar has two connecting holes disposed on two ends thereof and said connecter comprises a connecting bar and two connecting plugs disposed on two ends thereof, wherein said connecting bar has a smaller diameter than that of said supporting bar, and one end of said connecting bar being pushed into cavity of one end of said supporting bar to let said plug disposed on said end of said connecting bar plug into said connecting hole disposed on said end of said supporting bar, whereby said connecter is connected to said supporter.

4. The outdoor furniture, as recited in claim 3, wherein said fixture comprises a first adhesion surface, a second adhesion surface fixed onto said surface of said floater, and an adhesion belt surrounding said supporting bar of said supporter, wherein said first adhesion surface of one end of said fixture is adhered to said second adhesion surface of the other end of said fixture to form a ring with said first adhesion surface as an inner surface, which is adhered to said adhesion belt to fix said supporting bar with said fixture, whereby said supporter is fixed onto said floater by said fixtures.

5. The outdoor furniture, as recited in claim 4, wherein said frame is formed in a shape selected from a group consisting of a chaise longue shape, a sofa shape, a chair shape and a bed shape.

6. The outdoor furniture, as recited in claim 1, wherein said supporting bar has two connecting holes disposed on two ends thereof and said connecter comprises a connecting bar and two connecting plugs disposed on two ends thereof, wherein said connecting bar has a smaller diameter than that of said supporting bar, and one end of said connecting bar being pushed into cavity of one end of said supporting bar to let said plug disposed on said end of said connecting bar plug into said connecting hole disposed on said end of said supporting bar, whereby said connecter is connected to said supporter.

7. The outdoor furniture, as recited in claim 6, wherein said fixture comprises a first adhesion surface, a second adhesion surface fixed onto said surface of said floater, and an adhesion belt surrounding said supporting bar of said supporter, wherein said first adhesion surface of one end of said fixture is adhered to said second adhesion surface of the other end of said fixture to form a ring with said first adhesion surface as an inner surface, which is adhered to said adhesion belt to fix said supporting bar with said fixture, whereby said supporter is fixed onto said floater by said fixtures.

8. The outdoor furniture, as recited in claim 1, wherein said supporter is a bar ring extended along edges of surface of said floater, wherein said connecter is a connecting ring surrounding bars of said supporters of adjacent two floaters to connect said supporters with each other, whereby said two floaters are bound together.

9. The outdoor furniture, as recited in claim 1, wherein said frame is formed in a shape selected from a group consisting of a chaise longue shape, a sofa shape, a chair shape and a bed shape.

10. A method of providing a floating system from outdoor furniture, comprising the steps of:

providing an outdoor furniture which comprises a frame and at least two floaters removably disposed on said frame to form said outdoor furniture;

removing said floaters from said frame and connecting said floaters with each other to form a floating system by binding said floaters with at least two connecting elements, wherein at least one of said connecting elements is provided at each of said floaters, wherein said connecting element comprises a supporter extended along edges of surface of said floater, a plurality of fixtures fixing said supporter onto said edges of said surface of said floater, and a connector, wherein said supporter comprises one or more supporting bars respectively extending along and being fixed by said plurality of fixtures onto edges of said surface of said floater;

fixing an inserter to said frame and pushing said inserter into a hollow of one of said floaters;

arranging said floaters in a pre-determined pattern; and connecting said supporters of adjacent floaters with said connectors.

11. The method, as recited in claim 10, wherein said floaters are arranged parallel with each other with a certain distance between each other.

12. The method, as recited in claim 10, wherein said supporting bar has two connecting holes disposed on two ends thereof and said connecter comprises a connecting bar and two connecting plugs disposed on two ends thereof, wherein said connecting bar has a smaller diameter than that of said supporting bar.

13. The method, as recited in claim 12, wherein said step of connecting said supporters of adjacent floaters with said connecters further comprises the steps of: pushing one end of said connecting bar into cavity of one end of a supporting bar of a floater to let said plug disposed on said end of said connecting bar plug into said connecting hole disposed on said end of said supporting bar; pushing another end of said connecting bar into cavity of one end of another supporting bar of adjacent floater to let said plug disposed on said end of said connecting bar plug into said connecting hole disposed on said end of said supporting bar; and repeating said connecting step to bind adjacent floaters with each other.

14. The method, as recited in claim 10, wherein said supporter is a bar ring extended along edges of surface of said floater, said connecter is a connecting ring surrounding bars of said supporters of adjacent two floaters to connect said supporters with each other, whereby said two floaters are bound together.

15. The method, as recited in claim 14, wherein said step of connecting said supporters of adjacent floaters with said connecters further comprises the steps of: arranging said supporters of adjacent two floaters with adjacent edges parallel and contacted; surrounding said supporters with at least two connecters on parallel portions; and repeating said connecting step to bind adjacent floaters with each other.

16. The method, as recited in claim 15, wherein said connecter is a selected from a group consisting of a connecting ring with one end removable adhered to the other end, a connecting ring with one end removable locked with the other end, and a connecting ring with one end removable fixed with the other end.

17. The method, as recited in claim 10, further comprising a step of providing at least one handle on said floaters for facilitating said floaters to be pulled away from said frame.

18. The method, as recited in claim 10, wherein said frame is formed in a shape selected from a group consisting of a chaise longue shape, a sofa shape, a chair shape and a bed shape.

* * * * *